US007621301B2

(12) United States Patent
Wu et al.

(10) Patent No.: US 7,621,301 B2
(45) Date of Patent: Nov. 24, 2009

(54) METHOD OF IONIZED AIR-RINSING OF CONTAINERS AND APPARATUS THEREFOR

(75) Inventors: Rei-Young Wu, Palatine, IL (US); Richard Schutzenhofer, Naperville, IL (US); Anthony L. Armstrong, Algonquin, IL (US); Timothy Thomas Olsem, Elburn, IL (US); Robert Kent Rusher, Crystal Lake, IL (US)

(73) Assignee: The Quaker Oats Company, Chicago, IL (US)

( * ) Notice: Subject to any disclaimer, the term of this patent is extended or adjusted under 35 U.S.C. 154(b) by 347 days.

(21) Appl. No.: 11/403,448

(22) Filed: Apr. 13, 2006

(65) Prior Publication Data

US 2007/0240784 A1 Oct. 18, 2007

(51) Int. Cl.
*B65B 1/04* (2006.01)

(52) U.S. Cl. ..... 141/91; 141/63; 15/304; 15/306.1; 15/309.2; 134/22.1; 134/37; 239/566

(58) Field of Classification Search ..... 141/340, 141/8, 63, 89, 91, 367; 15/304, 306.1, 309.2, 15/303; 134/152, 21, 22.1, 22, 18, 23, 24, 134/25.1, 25.2, 25.4, 26, 30, 32, 34, 36, 37, 134/1; 239/566, 556, 599, 601, 592, 596; 198/402

See application file for complete search history.

(56) References Cited

U.S. PATENT DOCUMENTS 1,445,899 A * 2/1923 McGregor ..... 198/416
2,813,754 A * 11/1957 Zielinski ..... 239/424
2,980,938 A * 4/1961 Whelan ..... 15/304
4,208,761 A * 6/1980 Ionescu ..... 15/304
4,313,767 A * 2/1982 Bemis et al. ..... 134/1
4,962,871 A * 10/1990 Reeves ..... 222/504
5,265,298 A * 11/1993 Young ..... 15/1.51
5,881,429 A * 3/1999 Drewitz ..... 15/304

* cited by examiner

*Primary Examiner*—Timothy L Maust
*Assistant Examiner*—Jason K Niesz
(74) *Attorney, Agent, or Firm*—Banner & Witcoff, Ltd.

(57) ABSTRACT

A method and system for cleaning containers being transposed through a container cleaning line, including an open-ended housing, a predetermined container flow path defined by the line of moving containers traversing the enclosure defined by the housing longitudinally, a first set of ionizing air nozzles mounted within the housing for directing ionized compressed air toward the containers in the container flow path, with at least one of the nozzles directing air flow into an open side of each container as it passes the nozzle and a second set of high velocity air nozzles mounted within the housing for directing high velocity compressed air toward the container flow path, the second set of high velocity nozzles being disposed along a direction essentially parallel to the container flow path with at least one of the nozzles flows directing high velocity air flow into the open side of each container as it passes the nozzle. Nozzle guards are provided to prevent contact between the containers and the nozzles.

24 Claims, 9 Drawing Sheets

METHOD OF IONIZED AIR-RINSING OF CONTAINERS AND APPARATUS THEREFOR

BACKGROUND OF THE INVENTION

1. Field of the Invention

This invention relates generally to an apparatus, system and method of ionized air rinsing of containers, and more specifically to the rinsing of such containers without use of water, brushes or other elements that come into direct contact with the containers.

2. Background Art

Empty containers, such as PET bottles, intended for filling with a liquid beverage typically become contaminated with foreign material, such as paper and wood dust, during shipping, even when they are stored in boxes or other carrying receptacles and also as they are being processed prior to filling. In the latter case, contact between the containers and the surfaces of articles, such as conveyors or carriers, used to convey the containers, cause them to pick up a small amount of net electrostatic charge, thereby rendering them capable of attracting fine particles to the containers' internal and external walls. Thus, the need to rinse or otherwise clean the containers prior to filling is necessary to ensure that the beverages are acceptable to the ultimate consumer.

The dust particles contaminating these containers are characteristically extremely small, often measuring less than 10 microns in diameter. Any electrostatic charges on the containers induce opposite charges on the particles to attract and hold them on the containers' walls. To remove particles adhering to the walls, these opposite charges must be neutralized. Neutralizing the charges is difficult, however, because the charges holding each dust particle to a container's wall are shielded by the dust particle itself. Moreover, once the electrostatic forces have been momentarily abated, the freed dust particles must be removed immediately before they re-attach themselves to a container.

Several methods have been used to provide a thorough cleaning of the inside of a bottle. In the prior art methods, the processing of empty containers in preparation for filling them with beverages and the like included spraying the containers with water. This cleaning technique, however, fails to remove all of the dust particles inside the containers unless extraordinary measures are taken. Moreover, the high humidity generated by the water sprays favors the growth and spread of microorganisms, creating additional problems in the typical factory environment.

Other methods utilize a hot water rinse directed into a bottle having a downwardly facing opening, wherein a large number of bottles are being transported through a conveyor system at a high rate of speed. An example of such a cleaning arrangement is disclosed in U.S. Pat. No. 5,363,866. A jet nozzle arrangement is taught which provides an aeration and distribution of a cleaning agent at successive stations in the conveyor line.

The use of hot water or chemical disinfectants typically has been considered unsuitable for rinsing PET bottles prior to filling because hot water or disinfectants may chemically or physically alter the characteristics of PET bottle material. Such alterations could render the bottles unsuitable for containing beverages, or may adversely affect the quality or taste of the beverage, or may even render the beverage unsuitable for human consumption.

Various devices and processes not using unsuitable chemicals or excessively hot water have been proposed for sanitizing containers such as bottles. For example, devices using ozone or ozonated water as a sanitizing agent have been proposed. Ozone is highly reactive and is an effective oxidizing agent for sanitizing containers. Ozonated rinse water is preferable to untreated rinse water because it may be effective in removing microbes and other contaminants without changing the chemical or physical nature of the container. For example, Silberzahn U.S. Pat. No. 4,409,188 proposes a device for sterilizing containers that comprises a rotatable immersion wheel for immersing the containers in a bath of ozone and water. Hughes U.S. Pat. No. 5,106,495 proposes a portable water purification device using ozone as a treatment agent circulated by a pump through a venturi where the ozone is injected into the water, which is then returned to the tank after cleaning. However, the use of water or other liquid rinse media slows the rinsing process as a result of the need to dry or otherwise remove the liquid from the container prior to filling, which takes time and slows down the container preparation and filling procedure.

Another consideration of those prior art methods and systems that have a fluid or jet stream that is directed into the container, and especially those which intrude thereinto by inserting a nozzle or other means of producing a jet flow into the enclosure of the container itself, is that there is a possibility for introduction of extraneous matter and/or contamination into the bottle, which presently requires measures to avoid the possibility of such contamination. Additionally, methods which require the insertion of a nozzle into a container complicate and slow the cleaning process, because the container must be aligned fairly precisely with the nozzle and held in position for some period of time.

Other methods for cleaning containers of dust and debris, and more specifically, cleaning of plastic or PET bottles, are known, but most of these are similar to those prior art methods and systems described above. Ionized gas streams injected into upside down containers are taught in U.S. Pat. No. 4,208,761 to Ionescu and U.S. Pat. No. 5,265,298 to Young. The latter patent teaches a series of ionized nozzles staggered with intervening vacuum collectors to enable capture of ionized dust particles immediately after they have been "loosened" from the internal surface of a container. It should be noted that the ionized nozzles are expensive, and a configuration having only ionized nozzles in a long container cleaning station will cause the complete container cleaning system to be overly expensive. In addition, U.S. Pat. No. 5,265,298 does not have any type of guard or means to maintain a clearance between the nozzles and the fast moving containers that are sped past on guard rails. Accordingly, it becomes possible that misalignment of the elements of the system may cause the displacement of one or more nozzles such that a container that is skewed may collide with the nozzle at a high rate of speed, thus causing damage not only to the container but perhaps also to the nozzle, and shutting down the container processing line for repairs for a considerable period.

What is needed is a cleaning procedure that is efficient, effective, relatively inexpensive and does not produce undesirable effluents or other residual elements, such as rinse water residue, while simultaneously providing resource conservation and sustainability. A configuration that protects the sensitive elements of the system is also desirable to reduce down time and expensive replacement parts of the system.

SUMMARY OF THE INVENTION

Figure 1:
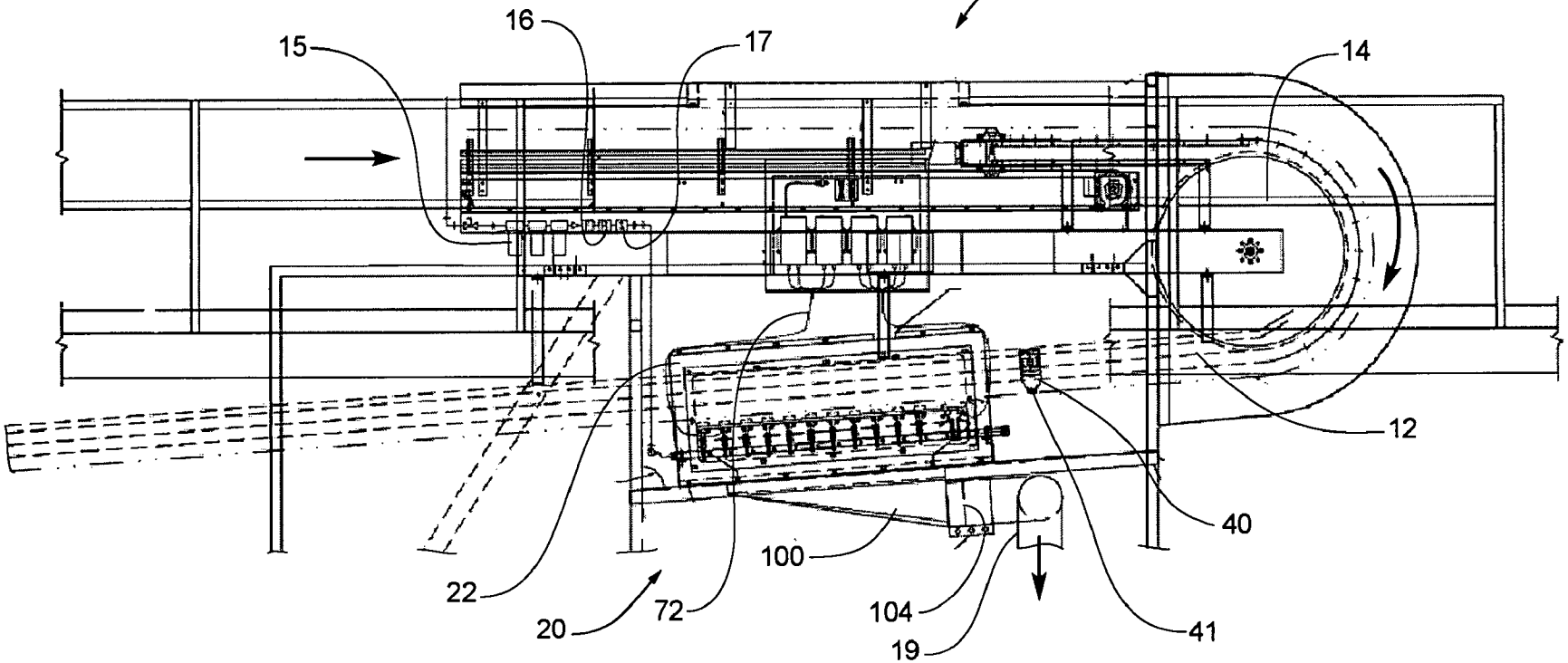
FIG. 1 is an elevation view of a pertinent portion of the container processing system according to the present invention.

The present invention is directed to an improved container cleaning apparatus and method for cleaning, without the use of water sprays, open-topped containers such as bottles as they travel along an assembly line. The containers preferably enter the apparatus in an upside down position and are carried in an essentially horizontal direction through an enclosure or housing as they are transported through the system. The containers may be conveyed through the apparatus on a moving belt, preferably having inwardly extending fingers.

The apparatus further includes one or more cleaning stations disposed within the housing and positioned immediately below the bottle flow path, with the highest points of each cleaning station being disposed slightly downwardly of an imaginary plane through which the openings of the bottles traverse. Each cleaning station comprises an ionized air injector with a series of nozzles and a second series of high velocity nozzles downstream from the ionized air nozzles, which provide turbulent air flow that ejects the dust particles from the inside of the containers and from the immediate vicinity of the containers.

As the containers are transported through the housing, an ionized air stream is directed from the ionizing nozzles into each empty container to dislodge any dust particles there and to neutralize electrostatic charges on the particles and the container walls. Suction from the vacuum inlet, a pan or slot situated immediately below the conveyor and ionized gas nozzles through which the ionized air flow is injected, removes dislodged dust particles. Dust removal with the apparatus is enhanced when the vacuum pan or slot is located beneath the ionizing nozzles at the front or entrance end of the longitudinal axis of the bottle flow path. Greater turbulence increases the likelihood that a dust particle, once it has been suspended in these air flows, will be removed from the container altogether, improving cleaning efficiency.

When more than one set of cleaning nozzles is employed in a cleaning system according to the present invention, the nozzles are preferably deployed in close proximity to each other. Such an arrangement of the nozzles takes advantage of the dislodgement of dust particles occurring as a result of the containers being subjected first to the air stream of the ionized gas nozzles and then to the high velocity air nozzles as the air flows through the interior of the containers at successive cleaning stations disposed immediately upstream of each other.

To prevent recontamination of the containers by their exposure to the dust particles floating in the air, the enclosure is preferably pressurized with filtered air from the nozzles, using a blower with an inlet filter, and evacuated of the dusty air by a vacuum blower that immediately evacuates any air in the housing before the dust particles can adhere to the container surfaces.

Accordingly, there is provided a waterless, brushless apparatus for removing dust particles from empty containers while they move forwardly in a line along a predetermined container flow path, each container having at least one open side, the open side facing in a generally common direction with the open side of each of the containers contiguous with said container, comprising an open-ended housing, the predetermined container flow path traversing the enclosure longitudinally in the direction of forward movement in the container flow path, a first set of ionizing air nozzles mounted within the housing, the ionizing air nozzles adapted for directing ionized compressed air toward the container flow path, the nozzles being oriented to direct air flow generally perpendicularly to the direction of forward motion of the containers along the predetermined ionizing air nozzles, so that ionized compressed air directed from at least one of the nozzles flows into the open side of each container as it passes the nozzle; and a second set of high velocity air nozzles mounted within the housing, the high velocity air nozzles adapted for directing high velocity compressed air toward the container flow path, the second set of high velocity nozzles being disposed along a direction essentially parallel to the container flow path with the nozzle openings being oriented generally perpendicularly to the direction of forward motion of the containers along the predetermined flow path, so that high velocity compressed air directed from at least one of the nozzles flows into the open side of each container as it passes the nozzle.

Also disclosed and claimed is a method of air rinsing containers by passing through a waterless, brushless air rinsing system comprising providing an air rinsing apparatus having a first set of ionizing air nozzles and a second set of high velocity air nozzles, and a vacuum source for evacuating the air around the containers, passing, at a high rate of speed, plural containers having a downwardly facing open side over the air streams emitted from the nozzles, and evacuating the air and any entrained foreign particles from the immediate environment of the containers by the suction provided by the vacuum source.

DETAILED DESCRIPTION OF THE PREFERRED EMBODIMENTS

Referring now to the figures, in which like corresponding reference numerals are used to designate like or corresponding parts throughout the several views, a preferred embodiment of the inventive air rinsing apparatus is shown.

A part of a container cleaning system 10 according to the present invention is shown in FIG. 1. The system portion shown is that portion of the bottle processing line that cleans the inside of the bottles, one bottle 40 which is shown, as they are transported through the system 10. The bottles 40 are transported through the system so that each bottle traverses the various stations, for example, the bottle gripping station (not shown) or the bottle cleaning station shown in FIG. 1. The bottle line provides a series of guards, shown in phantom in FIG. 1, that retain the bottles 40 in a conveyor arrangement 12 that permits the bottles to pass through each station at a very high rate of speed, on the order of 800 bottles per minute.

The system 10 includes additional elements, which are not shown. These are for the most part conventional and will be known to those of ordinary skill in the art. Those elements shown in FIG. 1 that are not specifically part of the invention will thus be described only in passing, the present disclosure being directed mostly to the invention including the bottle cleaning system 20, as shown in FIG. 1.

The conveyor arrangement 12 transfers the bottles 40 so the bottle flow path follows the direction of the arrows, and as a result of the bottle path passing around a large pulley rotating wheel 14, the bottles become inverted in a generally upside down position with the opening being downwardly directed, as shown by bottle 40 in FIG. 1. The bottles are preferably held in the conveyer arrangement by finger grippers 39 (shown in FIG. 3). Such finger grippers are available, for example, from Ambec, Inc. of Lynchburg, Va.

The other elements that are shown in FIG. 1 that relate to the inventive bottle cleaning system and method are the air filters 15, the air regulators 16 and flow indicators 17, all of which are connected electrically and through piping to the inlet of the forced air distribution inlet of the bottle cleaning system 20, as will be described in greater detail below. Additionally, an ionization control panel (not shown) is also connected electrically to the ionizing nozzles disposed within the bottle cleaning station 20 to provide operator control. An air duct 19, leading to a vacuum blower (not shown) for withdrawing air from the air cleaning system 20 through a series of ducts as will be explained in greater detail below.

Figure 3:
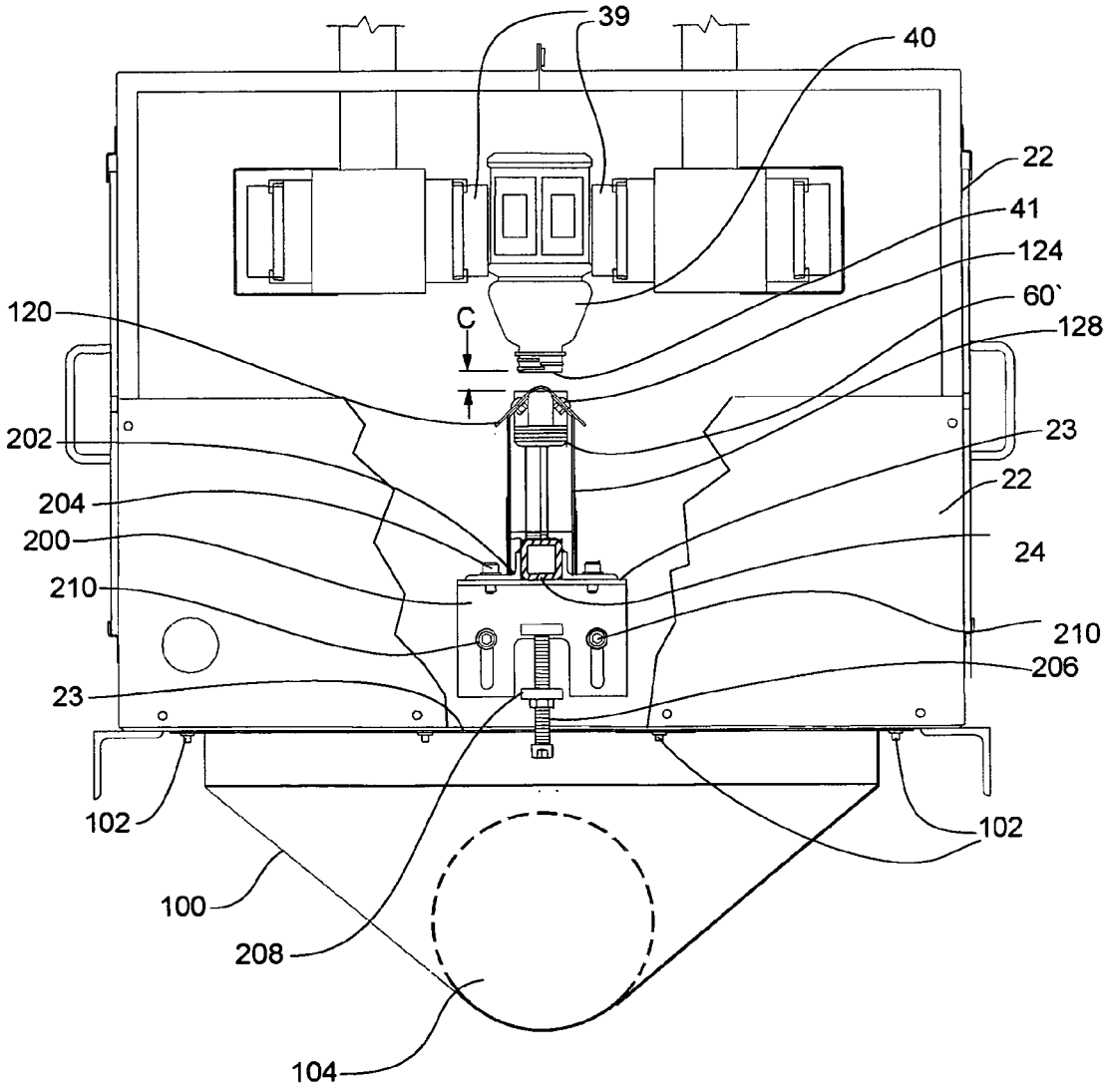
FIG. 3 is a partially cutaway side elevational view of the container cleaning station shown in FIG. 2.

The air cleaning system 20 is essentially enclosed by housing 22 providing an enclosure to maintain substantial equilibrium of air flow within the system 20. Of course, two openings, one of which is shown in FIG. 3, disposed at either longitudinal end of the enclosure 22 are required to permit the passage of the bottle path, so that the enclosure cannot be fully isolated from the environment.

Figure 2:
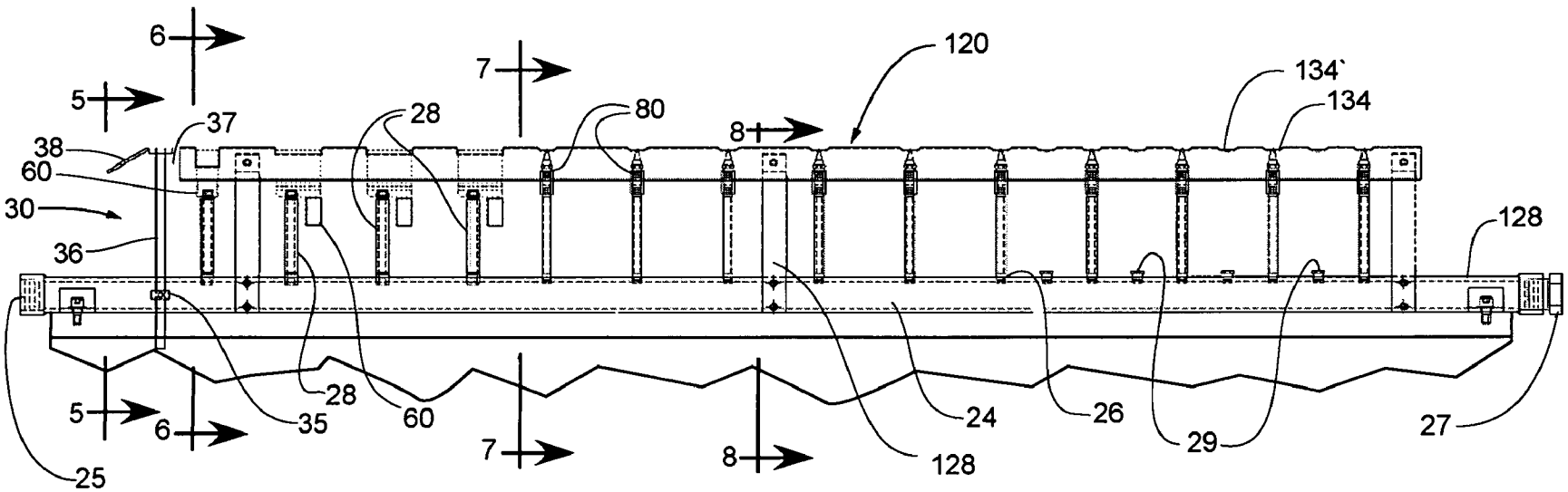
FIG. 2 is an elevational view of a container cleaning station according to the present invention as a part of the system shown in FIG. 1.

Referring now to FIG. 2, a detailed view of the elements of the bottle cleaning system 20 is shown, without the housing 22. The essential elements of the cleaning system 20 include the high pressure air flow manifold 24 having an inlet 25 at one end and a plug 27 at the far or downstream end. It should be noted that the orientation of the system 20 in FIG. 2 is the opposite of that shown in FIG. 1, and while the vertical orientation is shown slightly inclined in FIG. 1, as is preferable, the system 20 in FIG. 2 is shown horizontally flat, for purposes of easier illustration.

The manifold 24 includes attachment points for the additional elements of the system 20, including a series of spaced threaded outlet holes 26, to which the pipes 28, attached to different air nozzles, are threadably attached. Ideally, the threaded attachments of pipes 28 to the manifold 24 are air tight, to ensure essentially complete pressurized air flow through each of the nozzles. Various nozzle attachments may be provided for particular applications.

Figure 4:
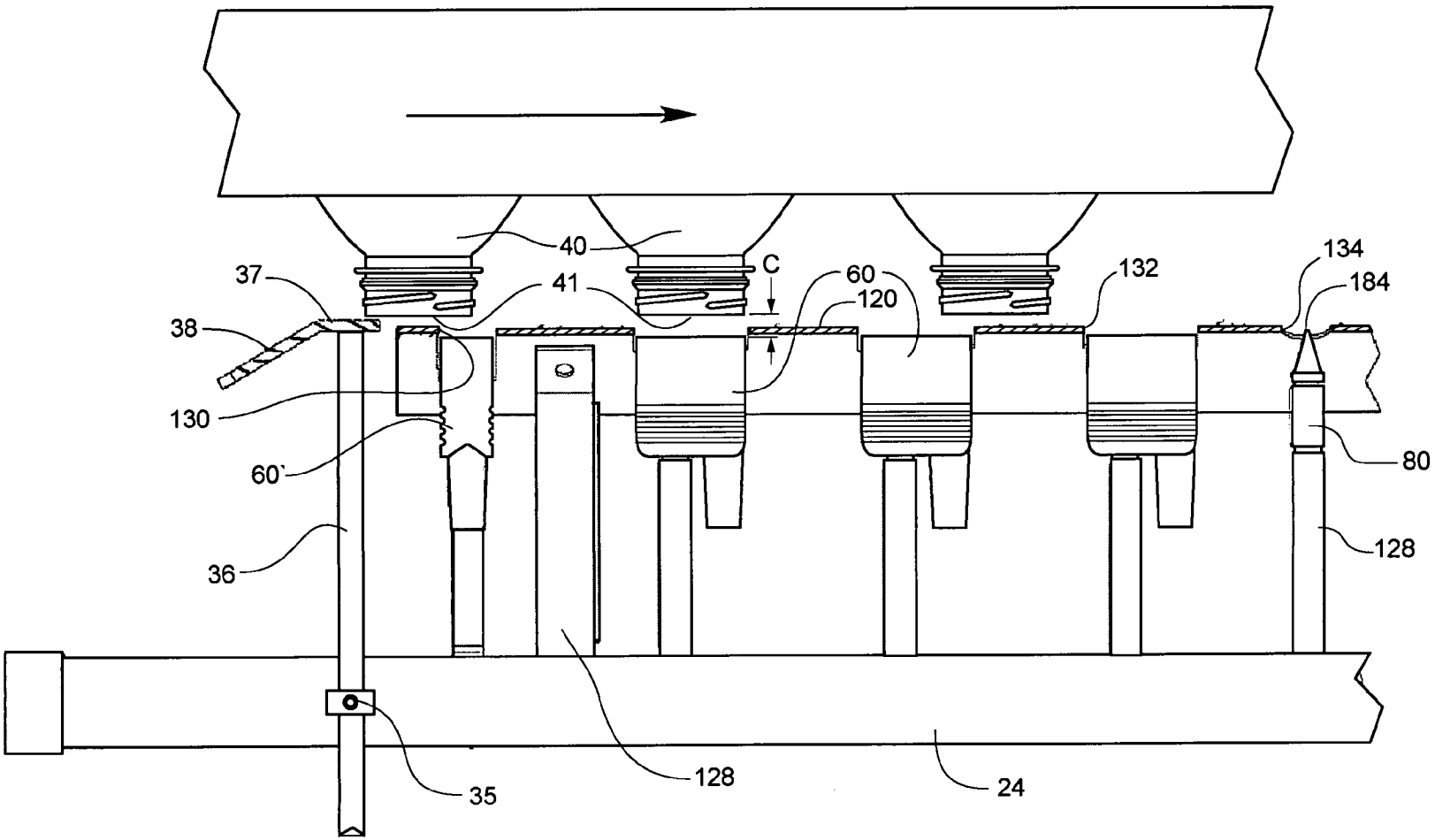
FIG. 4 is an elevational view of the container cleaning station according to the present invention showing multiple air nozzle stations for injection of pressurized air into the containers.
Figure 5:
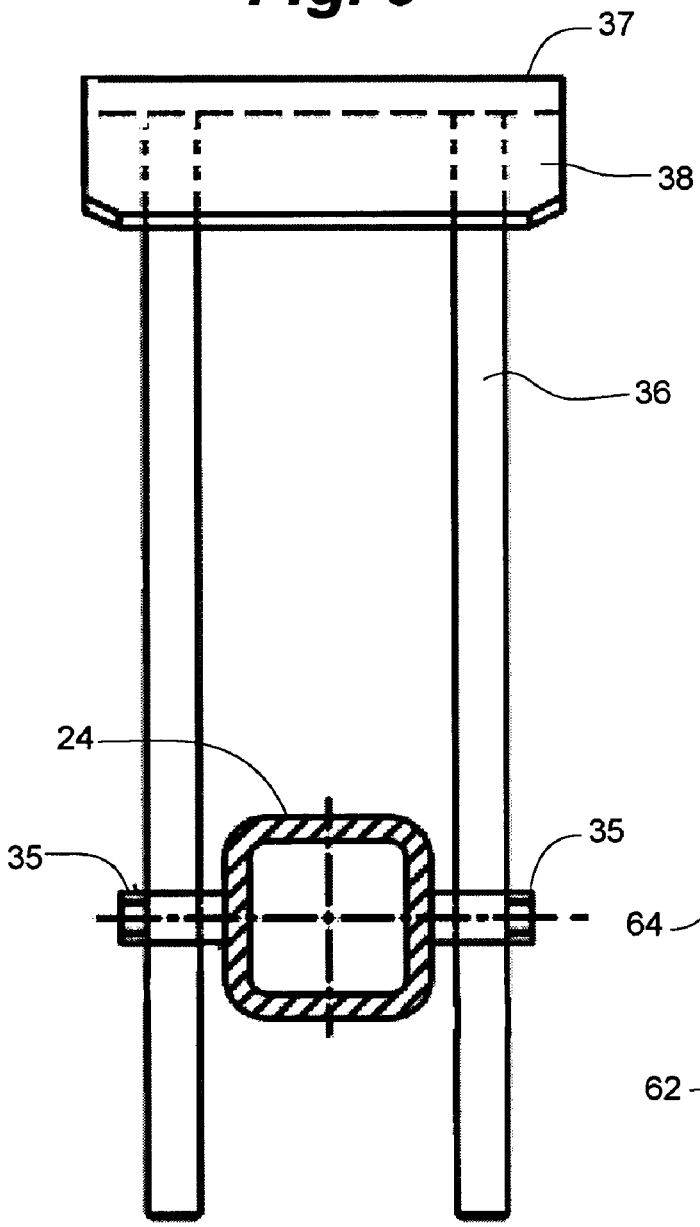
FIG. 5 is a cross-sectional view of the deflector guard taken approximately along line 5-5 of FIG. 2.

Referring now to FIGS. 2, 4 and 5, the deflector guard 30 will be described. All directions in the following description will be set forth in relation to the longitudinal axis of the horizontally inclined manifold 24, as is shown in FIG. 2. However, it should be kept in mind that the actual angle of the elements, for example, pipes 28, will be at a slight angle relative to the vertical when the manifold is inclined, as shown in FIG. 1.

The deflector guard 30 provides protection from the possibility that the bottle position of bottles 40 may have been skewed in the previous processing and the bottle opening may not be in the desirable vertical position relative to the tops of the nozzles. That is, as the bottles 40 travel through the station 20, they should be at or near a desirable vertical position and orientation, as they are gripped by the gripping fingers 39. If the vertical position has been displaced, so that in the upside down position the bottle opening 41 is too low, it may push or bump one or more of the nozzles that the bottle opening 41 initially encounters on the bottle path. Thus, the deflector guard 30 is disposed in a position prior to the first nozzle in the bottle path to reposition and orient each bottle in the bottle path upon entry to a desired position so as to avoid contact with any nozzle.

The bottle deflector guard 30 comprises a pair of adjustable supports 36 that are adjustably attached at one end of the longitudinally extending manifold 24 by set screws 35. Loosening of set screws 35 allows for the vertical adjustment of the deflector guard 30 so that the bottle openings are consistently at a desired vertical height relative to the top surface of the manifold, and consequently to the top portions of the nozzles. The deflector guard 30 further comprises two sections. A first horizontal section 37 that is essentially parallel to the longitudinal axis of the manifold 24 and is disposed at the vertical height above the manifold 24 to provide sufficient clearance to all of the nozzles in the bottle flow path. A second deflector section 38 is angled to provide a guiding force to the bottle opening 41 to push the bottle 40 up into the desired position in the retaining finger 39 of the conveying apparatus. The bottle 40 is carried by the conveying apparatus along the bottle path in the direction of the arrow, essentially along a line parallel to the longitudinal axis of the air manifold 24. If the bottle 40 is in the proper position, the bottle passes the deflector 30 without making contact. Otherwise, the bottle opening 41 impinges on the angled section 38 which because of the forward momentum of the bottle 40, pushes the opening 41 and the bottle 40 upwardly so that a clearance C is established between the highest point of the nozzles and the opening 41. The clearance C thus initially protects against any undesirable contact or impact between the bottles 40, which are moving at high speed, and the sensitive air nozzles, which can be damaged as a result of such impact.

Referring now to FIGS. 2, 4, 6 and 7, the nozzles attached to each of pipes 28 will be described in the context of the container cleaning system 10 and the flow path of the bottles 40. Bottles 40 are transported through the bottle cleaning station 20 at a high rate of speed, typically on the order of 800 bottles per minute. With the clearance C verified by the container deflector guard 30, the bottle openings 41 are transported so as to pass directly over the nozzles which are attached to each of the pipes 28, in fluid communication with the high pressure, filtered gas in the manifold 24.

Figure 6:
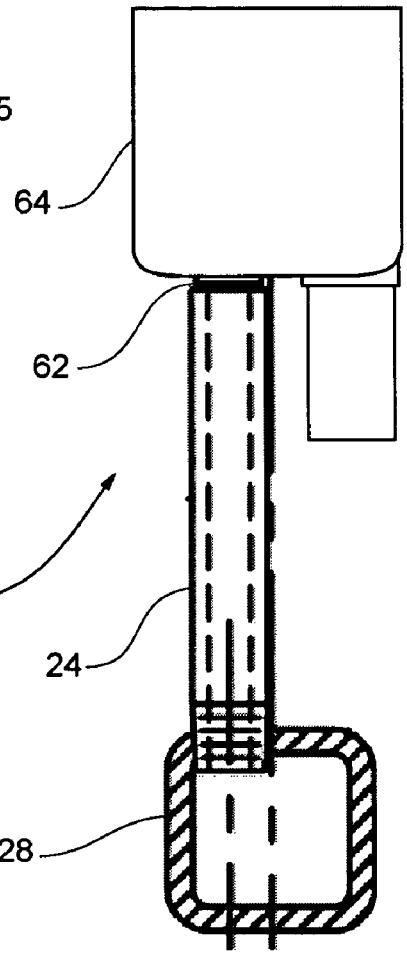
FIG. 6 is a cross-sectional view of the ionizing nozzle taken approximately along line 6-6 of FIG. 2.
Figure 7:
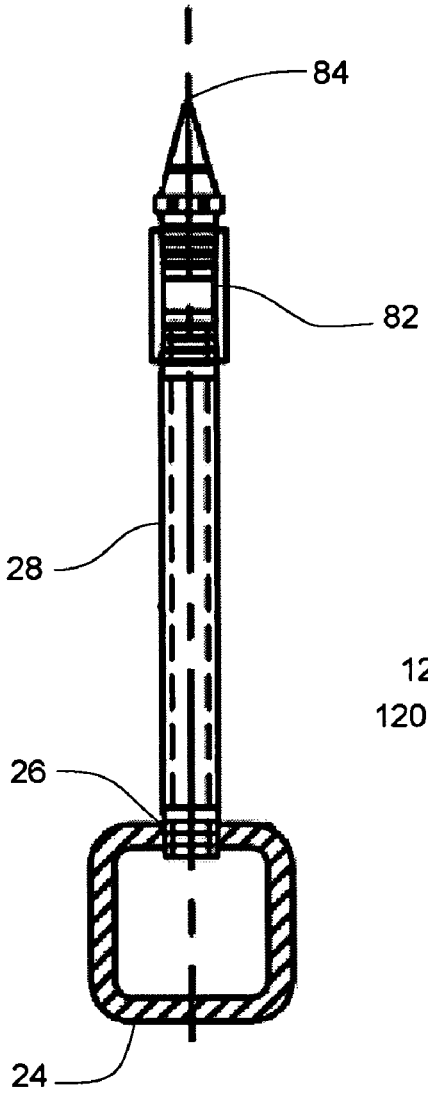
FIG. 7 is a cross-sectional view of the high pressure nozzle taken approximately along line 7-7 of FIG. 2.

As shown in FIGS. 2, 6 and 7, there are two types of nozzles, an ionizing nozzle 60 and a high velocity air nozzle 80. The ionizing nozzles 60 are attached to pipes 28 in a threaded connection 62 and receive the high pressure air from the manifold 24. The air passes through ionizing plates disposed internally of the ionizing nozzle 60. In the preferred embodiment, the ionized air stream is generated in the injector of the ionizing nozzle 60 by passing compressed air over one or more electrodes 64 located upstream of the nozzle threaded connection 62. The electrode 64, which is supplied with a high voltage, low frequency alternating current, causes air molecules to become charged. By way of example, an alternating current of 5 kV at 3 to 5 cycles per second has been found to be suitable for this application. In an apparatus for cleaning standard beverage containers, the compressed air is preferably maintained at a pressure of about 40 to 70 psi.

The ionized air is then passed over the external surface of the bottle 40 and into the bottle opening to provide ionized air that detaches any dust or other loose particles from the inner and outer walls of the bottle 40. Ionizing nozzles 60 that are available for use with the bottle cleaning apparatus 20 can be obtained commercially from the Simco Industrial Static Control Division of the Simco Company, Inc., Hatfield, Pa.

As is illustrated in FIGS. 2, 3 and 4, there are preferably four (4) nozzles used for ionizing the air, the first ionizing nozzle 60 encountered by the bottles 40 in the bottle path being a nozzle 60' that is disposed so that the longitudinal dimension is oriented in a direction 90° to the bottle path. This nozzle 60' provides an ionized air stream that flows over the outer surface of each bottle 40, so that any dust or other foreign particles on the outside surface of the bottle 40 is ionized, and then repelled from the bottle surfaces.

The remaining, preferably three nozzles, are oriented so that the longitudinal dimension of the nozzle 60 is parallel to the bottle flow path, thus providing the maximum amount of dwell time of the bottle opening 41 within the ionized air stream. This orientation thus directs the maximum amount of ionized air into the bottle interior so as to provide as much ionizing function as possible to the internal bottle surface, thereby ionizing and displacing essentially all of the dust particles from the internal surface. The displaced ionized dust particles float in the environment, and must be removed from the vicinity of the bottles 40.

Although four ionizing nozzles including one laterally oriented nozzle are described as comprising the preferred embodiment, other arrangements are also possible with more or fewer ionizing nozzles and with additional laterally oriented nozzles substituting for the arrangement illustrated.

To provide for the removal of the dust particles, the bottles 40 are then passed over the other types of nozzles, that is, the high velocity air nozzles 80, which are connected to each vertical pipe 28 by a threaded connection 82. The high velocity air nozzles 80 have a constriction to their outlets so that the opening 84 concentrates the pressurized air flow into a smaller jet stream that is directed into the bottle openings 41. The air pressure going into the pipe and nozzle 80 is at about the same pressure as the ionizing nozzles 60, that is, about 40-70 psi, but the air stream flow that is directed into the opening is at an increased velocity and pressure because of the concentration resulting from the constricted opening 84. With the bottles 40 traversing the area of each nozzle at a high rate of speed, the high velocity nozzles provide about 0.5-0.75 seconds of air contact time of the filtered compressed air. The high velocity air nozzles 80 thus are capable of injecting the high pressure air directly into the bottle opening 41 to circulate the air with a high degree of turbulence and at a high rate of speed within the bottle interior. This air circulation is provided almost immediately following the air ionization by the nozzles 60, 60', when the ionized particles are still essentially suspended in the air within or outside of the bottles 40. Thus, the injected air stream blows the suspended ionized particles out from the bottle interior and away from the opening 41. Ideally, the dwell time that any one bottle spends in the housing 22 is on the order of between 0.75 to 1.5 seconds, and the time each bottle is in contact with the ionized air from the ionizing nozzles 60, 60' is about 0.25 to 0.5 seconds, and because of the grater number of the high velocity nozzles 80, the time in contact with the air streams for the high velocity nozzles 80 is about between 0.5 to 0.75 seconds.

Referring now to FIGS. 1 and 3, vacuum pan 100 extends underneath the bottle flow path and underneath the high pressure air manifold 24. Vacuum pan 100 is essentially in the form of a trough that becomes shallower in the direction of the bottle flow path, shown by the arrow in FIG. 1. Along a centrally located longitudinal portion, the trough is folded, and at the point adjacent and directly beneath the ionizing nozzles 60, is connected, for example, by screws 102 to a vacuum duct 104, which is preferably in the form of a cylinder as shown in FIG. 3.

The vacuum duct 104 is itself connected to the duct 19 (FIG. 1) which is in fluid communication with a vacuum source (not shown) that provides a suction or vacuum force to the environment within the housing 22. The vacuum provided and powered by the vacuum source continually evacuates the air within the housing 22, together with any floating ionized dust or other particles that have been removed from the surfaces of the bottles 40. A suitable vacuum source is a Dayton model 2C940 blower. In this instance, the inlet of the blower is attached to the vacuum duct 19. Consequently, tiny particles that have been displaced from the bottle surfaces that remain entrained in the air within housing 22 are evacuated from the bottle environment and are no longer available to re-adhere to the surface again in the event they become deionized.

As is best seen in FIG. 4, the highest points of the nozzles 60, 80 are disposed only slightly below the opening 41 of the container 40 being transported directly over the nozzles. In the preferred embodiment, the highest points on the nozzles 60, 80 are disposed about one-half inch below an imaginary plane spanning the openings 41. That is, the clearance C between the lowest point of the opening 41 and the highest point of the nozzles 60, 80 is preferably in a range of about three-sixteenths to one-half inch (0.45-1.27 cm).

Figure 8:
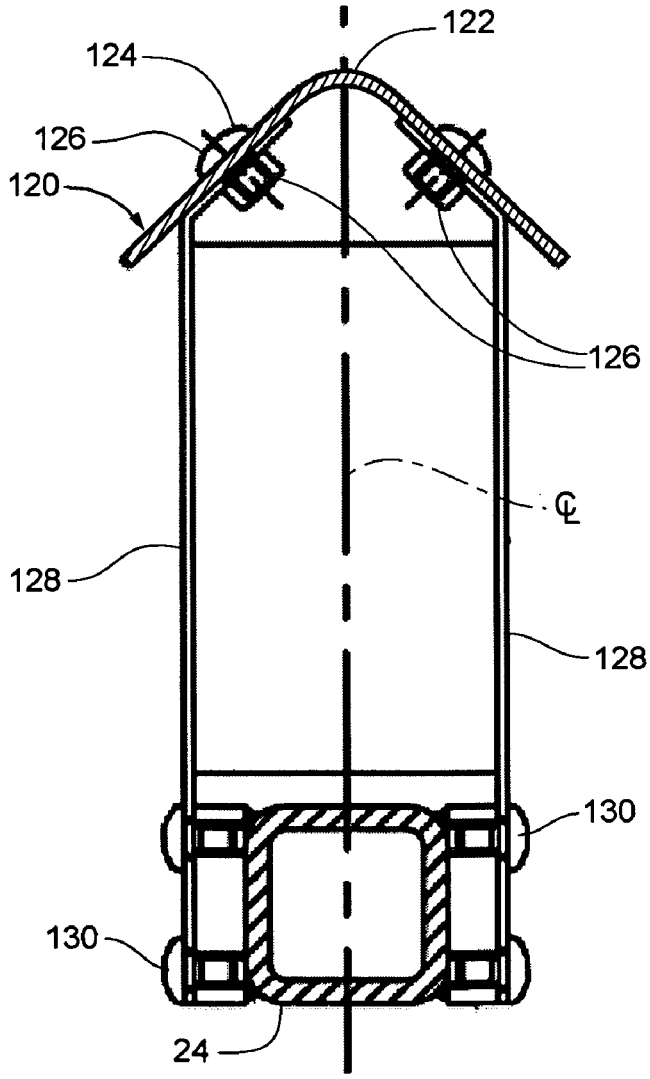
FIG. 8 is a cross-sectional view of the nozzle guard taken approximately along line 8-8 of FIG. 2.
Figure 9:
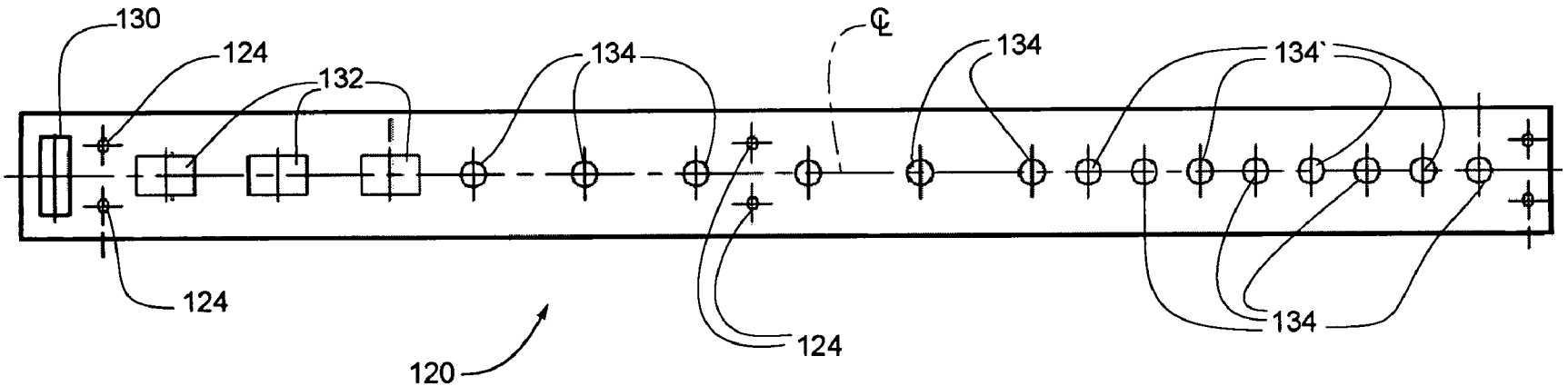
FIG. 9 is a plan view of the nozzle guard.

To further guard against the bottle openings 41 coming into contact with the sensitive nozzles 60, 60', and 80, there is disposed a nozzle guard 120 as shown in FIGS. 2-4 and 8-10. As is best seen in FIGS. 2 and 9, the nozzle guard 120 is a longitudinal element, preferably comprising a hard plastic material capable of withstanding shocks and perturbations that are experienced when a bottle 40 becomes misaligned during its movement and possibly impacts against guard 120. The nozzle guard 120 comprises essentially an elongated plate that has been folded along fold line 122 parallel to a longitudinal centerline CL so that the two lateral ends are essentially perpendicular to each other. The fold line 122 is shown in FIGS. 8 and 9 as being rounded, which is preferred, but a more peaked fold line or an arced profile are also possible, as long as the nozzle guard serves its intended function.

The nozzle guard includes several througholes 124 displaced from the centerline CL by a short distance for connecting the nozzle guard 120, by means of, for example, a bolt-nut combination 126 (FIGS. 3 and 8), to several pairs of mounting brackets 128, that are themselves connected by means of a threaded connection 130 to the gas manifold 24 at several locations along the length of the manifold 24. Alternatively, as shown in FIG. 2, the preferable locations of the connecting brackets 128 are adjacent the two longitudinal ends of the nozzle guard 120 and another pair of brackets 128 at a midpoint location between the two end mounting brackets 128. Other methods of mounting the nozzle guard 120 on the manifold may also be available, the exact method not being significant. However, it is considered important to mount the nozzle guard 120 onto either the manifold 24 as shown in FIGS. 2 and 8, or alternatively onto a separate vertically adjustable, longitudinally extending mounting block 200 (see FIG. 3) and otherwise described below. It is a significant feature of the present invention that the elements of cleaning system 20 be mounted on a common platform, so that vertical adjustability of the system 20 is assured by the simple vertical adjustment of the platform, for example, mounting block 200, to change or adjust the vertical position of the bottle cleaning system 20.

Figure 10:
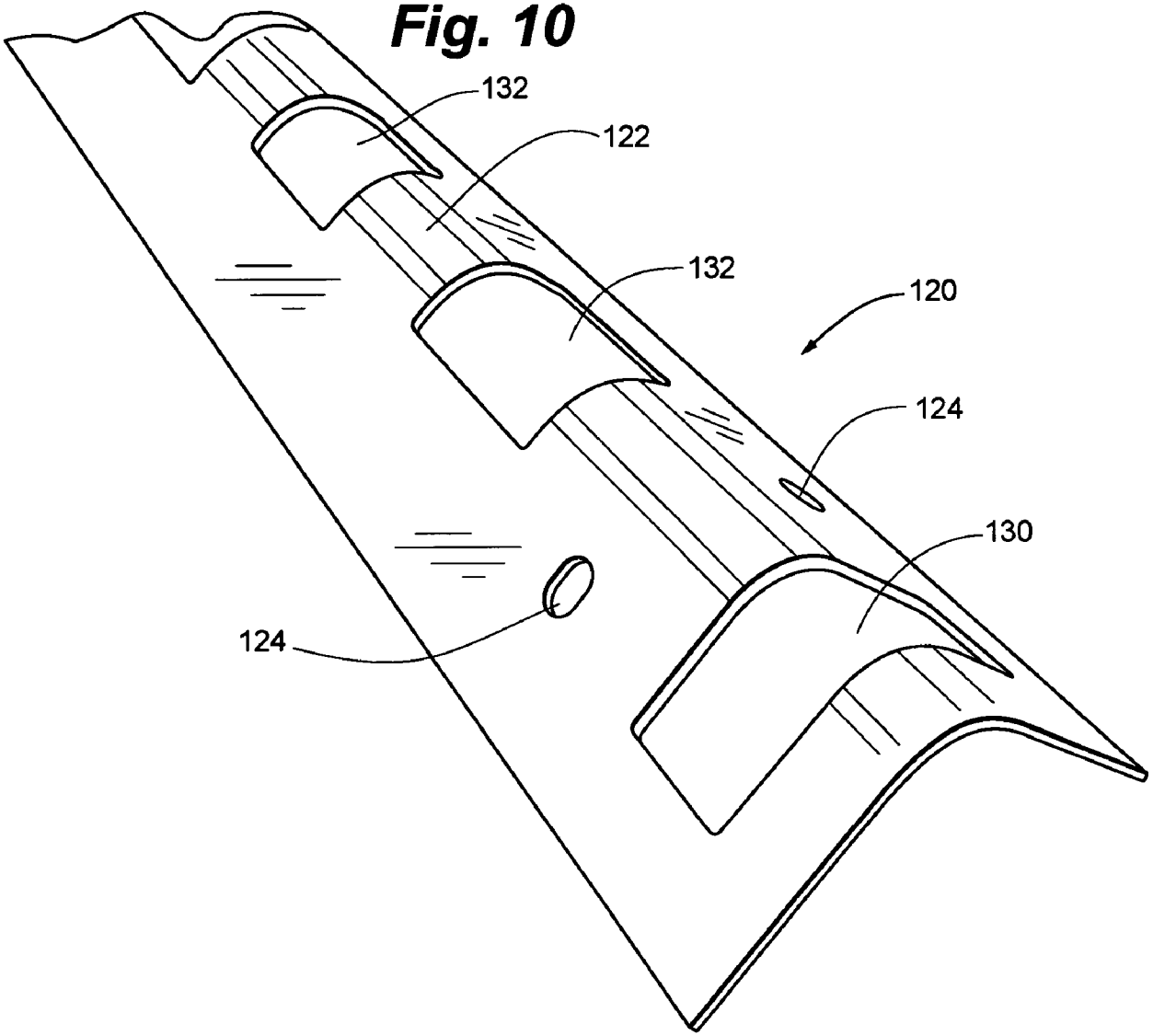
FIG. 10 is a perspective view of the nozzle guard of FIGS. 2 and 9.

Referring again to the nozzle guard 120, as shown in FIGS. 2-4 and 8-10, the nozzle guard 120 further comprises a number of apertures that are shaped and oriented to accommodate the disposition of each of the nozzles 60', 60, 80 that are mounted on the gas manifold 24. As viewed in the direction of the bottle flow path, the first is an ionizing nozzle aperture 130 for accommodating the laterally oriented ionizing air nozzle 60'. That is, the aperture 130 is cut in the form of a rectangle in the leading end of the nozzle guard 120 so that the middle of the longitudinal side straddles the fold line 122, as shown in FIGS. 9 and 10. The size and shape of the aperture 130 matches the ionized air stream flow that is expected to be emitted by the laterally oriented ionizing nozzle 60'.

Additional apertures 132, also matching the expected ionized gas streams that are emitted by the other, preferably three, ionizing nozzles 60 are disposed in line along the centerline CL and also straddling across the fold line 122. However, the longitudinal orientation of the rectangular apertures 132 is with the longer sides in a direction parallel to the centerline CL, thus matching the air stream flow of the ionizing nozzles 60. The apertures 130, 132 are equally spaced apart, matching the spacing of the ionizing nozzle 60',60, and as shown in FIGS. 9 and 10, the througholes 124 at the end of the nozzle guard 120 are disposed between the aperture 130 and the first downstream aperture 132.

Another set of apertures 134 are disposed through the body of the nozzle guard 120 to provide egress for the air streams of the high velocity nozzles 80 (FIGS. 2, 4) located downstream of the apertures 130. Those apertures 134 are preferably circular in shape so as to match the type of air stream emitted by those nozzles. Since the nozzles 80 are directed upwardly to emit a circular or conical air stream centered on the opening 84, the circular apertures 134 accommodates these air streams.

The apertures 134 are similarly spaced an equidistant length along the center line CL, but also include a second set of apertures 134' that are between any two adjacent apertures 134 downstream of a first set of central apertures 134. These second set of apertures 134', shown to not have an associated nozzle in FIG. 2, match up with manifold threaded holes 26 that are stopped by the plugs 29. In the event that additional high velocity nozzles (not shown) are desired in the system 20, the plugs 29 may be removed and threaded ends of additional pipes 28, having nozzles 80, may be screwed into the threaded apertures 26. This configuration will provide a final shot of high velocity air streams prior to the containers 40 exiting from the cleaning system 20 to minimize the dust that may be present on the containers 40.

Referring now to FIG. 4, where the nozzle guard 120 is shown in cross-section, the tops or highest points of each of the nozzles 60', 60 and 80 are shown to be slightly lower in overall height than the uppermost surface of the nozzle guard 120. Each of the nozzles 60,60' may protrude slightly beyond the top surface of nozzle guard 120, for example, see the protruding sides of nozzle 60' that extend beyond or above the aperture 130 in FIG. 3. However, none of the nozzle parts extend beyond the critical fold line 122, along which the cross-section of FIG. 4 is taken, and so the nozzles are protected from impact of bottles in the bottle flow path which extends parallel to and immediately above the fold line 122.

Another feature that was discussed briefly above, that of the adjustability of the vertical position of the system 20, will be described in greater detail with reference to FIG. 4. As has been noted, an alternative connection of the brackets 128 to the mounting block 200 may be achieved by an alternative means of connection of two lateral flanges (not shown) of the brackets 128 by screws directly to mounting block 200. Preferably, and as shown in FIGS. 1-8, all of the elements are connected to the gas manifold 24, and the gas manifold 24 is firmly mounted onto the mounting block 200 by a pair of flanged L-shaped brackets 202, one flange of which is attached to the mounting block 200 by threaded screws 204, and the other flange is attached to the manifold 24 by an appropriate means, for example, by set screws (not shown) or an interference fit. However the connection to the mounting block 200 is made, the feature provided by the connection is that the operable elements of the cleaning system 20 are unitary with the mounting block 200, so that when the mounting block 200 is moved, the cleaning system 20 also moves together therewith.

As can be seen in the partial cutaway view of FIG. 3, the mounting block 200 is an I-beam block with plural screw threaded adjusting bolts 206, each with an associated jam nut 208. A pair of bracket bolts 210 holds the mounting block 200 in the desired position relative to the bottom plate 23 of housing 22. The adjusting bolt 206 includes a nut or other manual or machine adjustable mechanism that facilitates rotation of the adjusting bolts 206.

Rotation of the adjusting bolt 206 raises or lowers the vertical height of the mounting block 200 to a desired position, at which position tightening of the mounting bracket bolts 210 fixes the relative height of the mounting block 200, and all of the cleaning system elements that are attached thereto. Thus, by slight adjustments to the adjusting bolts 206, the clearance C may be optimized for a particular size container 40. Grosser adjustments of the adjusting bolt 206 can modify the clearance C so that the cleaning system 20 may accommodate different size, i.e., smaller bottles, and shape, i.e., opening 41, for different sized and shaped containers (not shown), which can then be cleaned prior to the filling operation which may commence as soon as the bottle processing equipment returns the container 40 to its proper orientation with the opening 41 at the top (not shown in FIG. 1).

Figure 11:
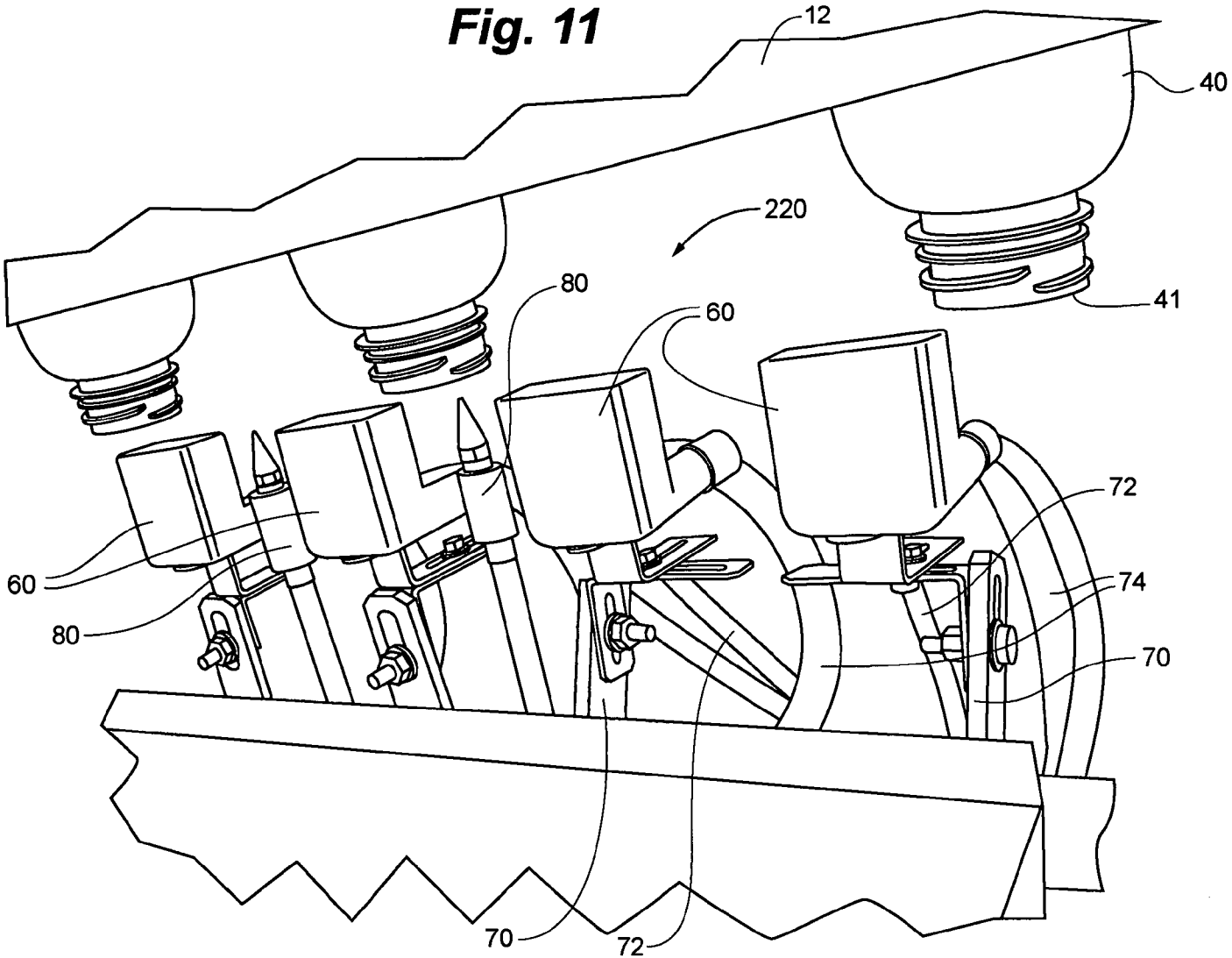
FIG. 11 is a cutaway perspective view of a container cleaning station according to another embodiment of the present invention.

Referring now to FIG. 11, an alternative arrangement or configuration 220 of the nozzles 60,80 is shown in a perspective view, in which the ionizing air nozzles 60 are in a partially staggered arrangement with the high velocity air nozzles 80. This view includes the bracket mountings 70 of the nozzles 60, and the electrical connections 72 that connect the ionizing nozzles 60 to the ionization control panel (not shown). Also shown in FIG. 11 are the flexible air pipes 74 for providing an alternate connection of the ionization nozzles 80 to the high pressure filtered air supply, for example, manifold 24 (FIG. 2). The nozzle guard has been removed for purposes of illustration.

The configuration 220 shown in FIG. 11 provides for quickly alternating the ionized air stream from nozzles 60 with the high velocity air stream from nozzles 80 that impinge into the bottle opening 41 and over the bottles 40. However, testing of the configurations shown in FIGS. 2 and 4 in comparison with that shown in FIG. 11 appears to indicate that cleaning capability is measurably reduced in the configuration 220 from the cleaning system 20 shown in FIGS. 1-10. Thus, the general configuration of the earlier described system 20 is preferable as it has been demonstrated to more efficiently remove dust and other foreign particles from the containers 40.

Of course, and as implied by the alternative nozzle configuration 220, other configurations are possible. For example, a fewer or greater number or relative ratio of the types of nozzles 60', 60 and 80 may be used to achieve varying desirable effects. For example, bottles having a smaller opening 41 may require more high velocity air streams from nozzles 80 to completely evacuate all the dust particles in a bottle of that shape. Other configurations, and changes, modifications and alterations may be made to the systems 20,220, which have been illustrated and described merely as examples and preferred embodiments of the desirable system.

It is apparent from the foregoing that a new and improved method and apparatus for waterless cleaning of containers has been provided. While only the presently preferred embodiment and an alternative nozzle configuration of the invention have been described in detail, as will be apparent to those familiar with the art, certain changes and modifications to the system and method for cleaning containers may be made without departing from the scope of the invention. Accordingly, the specific embodiments illustrated and described herein are for illustrative purposes only and the invention is not limited except as defined by the following claims.

What is claimed is:

1. Apparatus for removing unwanted foreign particles from empty containers while they move forwardly, in a line, along a predetermined container flow path, each container having at least one open side, the open side facing in a generally common direction with the open side of each of the containers contiguous with said container, comprising:

(a) an open-ended housing, the predetermined container flow path traversing the housing longitudinally in the direction of forward movement in the container flow path;

(b) a first set of ionizing air nozzles mounted within the housing, the ionizing air nozzles adapted for directing compressed ionized air toward the container flow path, the nozzles being oriented to direct air flow generally perpendicularly to the direction of forward motion of the containers along the predetermined container flow path, so that compressed ionized air directed from at least one of the nozzles flows into the open side of each container as it passes the nozzle; and (c) a second set of high velocity air nozzles mounted within the housing, the high velocity air nozzles adapted for directing high velocity compressed air toward the container flow path, the second set of high velocity nozzles being disposed along a direction essentially parallel to the container flow path with the nozzle openings being oriented generally perpendicularly to the direction of forward motion of the containers along the predetermined flow path, so that high velocity compressed air directed from at least one of the nozzles flows into the open side of each container as it passes the nozzle.

2. The apparatus according to claim 1 wherein the first set of ionizing air nozzles is disposed in the leading portion of the housing and the second set of high velocity air nozzles is disposed downstream in the housing relative to the direction of motion of the containers in the container flow path.

3. The apparatus according to claim 2 wherein the first set of ionizing nozzles comprises between three and five nozzles.

4. The apparatus according to claim 2 wherein the second set of high velocity air nozzles comprises between 5 and 20 nozzles.

5. The apparatus according to claim 4 wherein the first set of ionizing nozzles comprise between three and five nozzles.

6. The apparatus according to claim 2 wherein the ionizing nozzles have longitudinally shaped air outlets, and a first upstream ionizing air nozzle is oriented so that the longitudinal dimension extends transverse to the direction of the container flow path, the longitudinal dimension sized to extend beyond the open side of the container.

7. The apparatus according to claim 1 further comprising a nozzle guard interposed between the container flow path and the first and second set of nozzles, the nozzle guard further providing egress for the air stream emitted by each nozzle in an upward direction toward the container flow path.

8. The apparatus according to claim 7 wherein the nozzle guard further comprises an elongated planar element that has a longitudinal dimension extending essentially parallel to the container flow path.

9. The apparatus according to claim 8 wherein the nozzle guard provides egress for the air stream through an aperture in the nozzle guard for each nozzle; the aperture corresponding to the shape of the air stream emitted from the nozzle.

10. The apparatus according to claim 1 further comprising a container deflector disposed at the leading portion of the container flow path and prior to any nozzles relative thereto, in the direction of container flow, the container deflector having an angled portion oriented to deflect any containers upwardly thereby tending to avoid impact of the containers with the nozzles.

11. The apparatus according to claim 1 further comprising a high pressure gas manifold, the manifold being an elongated tubular arrangement providing fluid communication of high pressure gas to each of the first and second set of nozzles.

12. The apparatus according to claim 11 further comprising a mounting block, the mounting block providing a platform for the nozzles, wherein the mounting block has a height relative to the housing that is selectively adjustable.

13. The apparatus according to claim 12 wherein the nozzles are attached to threaded apertures in the gas manifold and a container deflector and a nozzle guard are all attached to the elongated, tubular gas manifold; and wherein the elongated, tubular gas manifold is attached to the mounting block.

14. The apparatus according to claim 11 wherein the gas manifold further comprises an elongated, tubular gas manifold that is square in cross-section.

15. The apparatus according to claim 1 further comprising a vacuum duct positioned below the nozzles, the vacuum duct connected to a source of vacuum for providing a suction force to evacuate the air and any entrained foreign particles from the housing.

16. A method of air rinsing containers passing through a waterless, brushless air rinsing system comprising:

a) providing an air rinsing apparatus having a first set of ionizing air nozzles and a second set of high velocity air nozzles, both sets of nozzles emitting a gas stream toward the containers, and a vacuum source extending underneath the plurality of air nozzles for evacuating the air around the containers;

b) passing, at a high rate of speed, plural containers having a downwardly facing open side over the air streams emitted from the nozzles; and c) evacuating the air and any entrained foreign particles from the immediate environment of the containers by the suction provided by the vacuum source.

17. The method of air rinsing containers according to claim 16 wherein the step of passing the containers over the air streams emitted from the nozzles further comprises passing the containers sequentially over the first set of nozzles and then over the second set of nozzles.

18. The method of air rinsing containers according to claim 16 further comprising before passing of the containers over the nozzles, deflecting the container open side in a direction away from the nozzles and into a predetermined flow path having a clearance C relative to the highest point of the nozzles.

19. The method of air rinsing containers according to claim 18 wherein the clearance C is in a range of about 0.18 to 0.5 inches.

20. Apparatus for removing unwanted foreign particles from empty containers while they move forwardly, in a line, along a predetermined container flow path, each container having at least one open side, the open side facing in a generally common direction with the open side of each of the containers contiguous with said container, comprising:

(a) an open-ended housing defining an enclosure, the predetermined container flow path traversing the enclosure longitudinally in the direction of forward movement in the container flow path;

(b) a plurality of air nozzles mounted within the housing, the air nozzles adapted for directing compressed air toward the container flow path, the nozzles being oriented to direct air flow generally perpendicularly to the direction of forward motion of the containers along the predetermined container flow path, so that compressed air directed from at least one of the nozzles flows into the open side of each container as it passes the nozzle; and (c) a nozzle guard interposed between the container flow path and the plurality of nozzles, the nozzle guard further providing egress for the air stream emitted by each nozzle in an upward direction toward the container flow path wherein the nozzle guard provides egress for the air stream through an aperture in the nozzle guard for each nozzle, the aperture corresponding to the shape of the air stream emitted from the nozzle.

21. The apparatus according to claim 20 wherein the nozzle guard further comprises an elongated planar element that has a longitudinal dimension extending essentially parallel to the container flow path.

22. An apparatus for removing unwanted foreign particles from empty containers while they move forwardly, in a line, along a predetermined container flow path, each container having at least one open side, the open side facing in a generally common direction with the open side of each of the containers contiguous with said container, comprising: an open-ended housing defining an enclosure, the predetermined container flow path traversing the enclosure longitudinally in the direction of forward movement in the container flow path; a plurality of air nozzles mounted within the housing, the air nozzles adapted for directing compressed air toward the container flow path, the nozzles being oriented to direct air flow generally perpendicularly to the direction of forward motion of the containers along the predetermined container flow path, so that compressed air directed from at least one of the nozzles flows into the open side of each container as it passes the nozzle; and a nozzle guard interposed between the container flow path and the plurality of nozzles, the guard further providing egress for the air stream emitted by each nozzle in an upward direction toward the container flow path, wherein the nozzle guard comprises an elongated plate that has been folded along a fold line parallel to a longitudinal centerline whereby creating two lateral ends which are perpendicular to each other; and wherein, the elongated plate is positioned directly over the plurality of nozzles.

23. The apparatus according to claim 1 further comprising a vacuum pan extending underneath a high pressure gas manifold wherein the vacuum pan is connected to a vacuum duct.

24. The container deflector according to claim 10 further having a horizontal section extended from the angled portion and oriented to deflect any containers horizontally thereby tending to avoid impact of the containers with the nozzles.

* * * * *